United States Patent [19]

Clay

[11] Patent Number: 4,574,919

[45] Date of Patent: Mar. 11, 1986

[54] TREE CLIMBING IMPLEMENT

[76] Inventor: Michael D. Clay, 6307 E. Oklahoma Pl., Tulsa, Okla. 74115

[21] Appl. No.: 682,306

[22] Filed: Dec. 17, 1984

[51] Int. Cl.[4] ..... A63B 27/00

[52] U.S. Cl. ..... 182/221; 182/134

[58] Field of Search ..... 182/221, 134

[56] References Cited

U.S. PATENT DOCUMENTS

| | | | |
|---|---|---|---|
| 628,070 | 7/1899 | Butler | 182/221 |
| 938,905 | 11/1909 | Speerstra | 182/221 |
| 1,499,733 | 7/1924 | Hegemann | 182/134 |
| 2,808,974 | 10/1957 | Bessinger | 182/221 |
| 2,870,947 | 1/1959 | Hendry | 182/221 |
| 3,025,927 | 3/1962 | Stein | 182/221 |
| 3,032,141 | 5/1962 | Barton | 182/221 |
| 3,078,951 | 2/1963 | Schneebeli | 182/221 |
| 3,297,105 | 1/1967 | Lawrence | 182/221 |
| 4,153,139 | 5/1979 | Houch | 182/221 |

*Primary Examiner*—Reinaldo P. Machado

*Attorney, Agent, or Firm*—Head, Johnson & Stevenson

[57] ABSTRACT

A tree climbing implement adapted to be secured to the boot or shoe during a tree climbing operation and comprising a substantially L-shaped bracket engagable with the bottom of the boot, a spike-like element has one edge hingedly secured to one edge of the L-shaped bracket member and is movable between an extended position substantially perpendicular to the bracket member and a collapsed position substantially against or in abutting relation with respect to the bracket member for facilitating storing and/or transporting of the device. The spike-like member is of a unitary construction which greatly reduces the cost of manufacture of the implement.

2 Claims, 6 Drawing Figures

TREE CLIMBING IMPLEMENT

BACKGROUND OF THE INVENTION

1. Field of the Invention

This invention relates to improvements in tree climbing devices and more particularly, but not by way of limitation, to a hinged tree climbing device for facilitating storage and transporting of the device when not is use.

2. Description of the Prior Art

Many sportsmen, such as hunters, frequently climb trees in the wilderness areas, and the like, during the exercise of their sport. Since many trees may not have low hanging branches, and the distance from the ground to the lowermost branch may be somewhat great, it is common practice to use tree climbing devices which may be attached to a shoe, boot, or the like, and which are provided with spike members for penetrating the trunk of the tree whereby the person may more readily climb the tree. Examples of such tree climbing devices are shown in the Bessinger U.S. Pat. No. 2,808,974; Hendry U.S. Pat. No. 2,870,947; Stein U.S. Pat. No. 3,025,927; Barton U.S. Pat. No. 3,032,141; Schneebeli et al U.S. Pat. No. 3,078,941; Lawrence U.S. Pat. No. 3,297,105 and the Houch U.S. Pat. No. 4,153,139. These devices have certain disadvantages in that the construction of the climbers is substantially rigid, and the sharp spike-like elements of the climbers may accidentally inflict pain or bodily damage when the devices are being stored or are being transported when not in service or use. In addition, the construction of many of these devices is quite expensive.

SUMMARY OF THE INVENTION

The present invention contemplates a novel hinged tree climbing device which has been particularly designed and constructed for overcoming the foregoing disadvantages. The novel device comprises a substantially L-shaped bracket member adapted to engage the sole or a boot, shoe, or the like, and a unitary spike-like element hingedly secured to one edge thereof whereby the entire device may be folded into a compact unit when not in use. The spike-like element is constructed from a single strap member by a metal forming procedure which permits the hinged connection of one end thereof with the L-shaped bracket member. The tree climbing device may be quickly and easily installed on the boot or shoe of the user and functions for efficiently facilitating the tree climbing operation. When not required, the device may be quickly and easily removed from the the foot and folded into a compact storage unit. The novel tree climbing device is simple and efficient in operation and economical and durable in construction.

DETAILED DESCRIPTION OF THE PREFERRED EMBODIMENT

Figure 2:
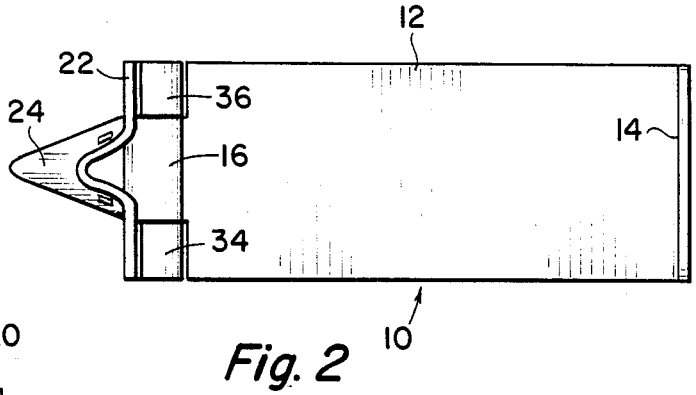
FIG. 2 is a plan view of a tree climbing implement embodying the invention.
Figure 4:
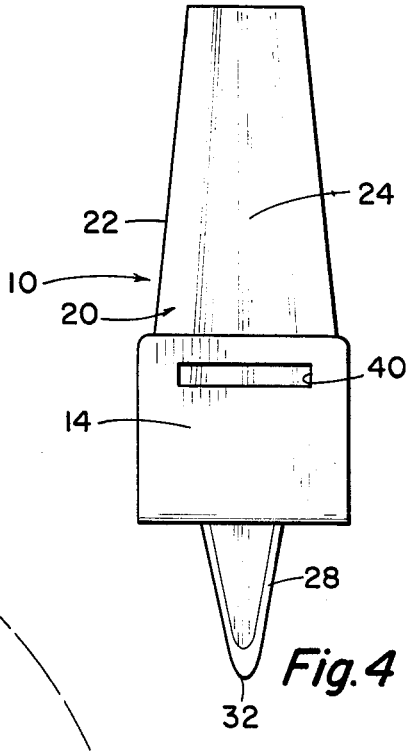
FIG. 4 is a rear elevational view of a tree climbing implement embodying the invention.
Figure 5:
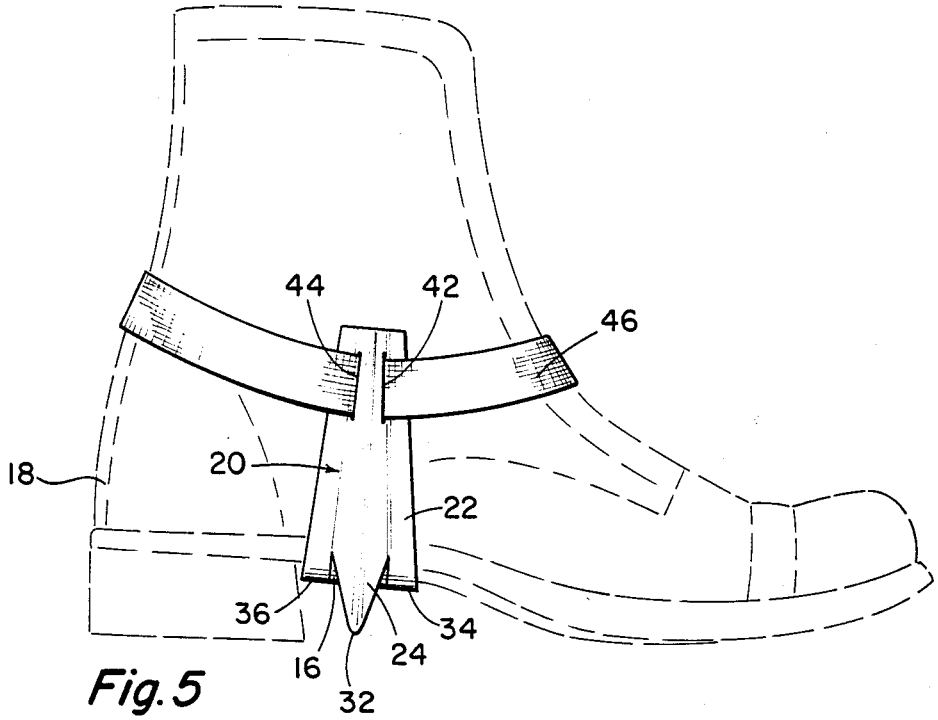
FIG. 5 is an elevational view of one side of a boot having a tree climbing implement embodying the invention attached thereto, the boot being shown in broken lines for purposes of illustration.
Figure 6:
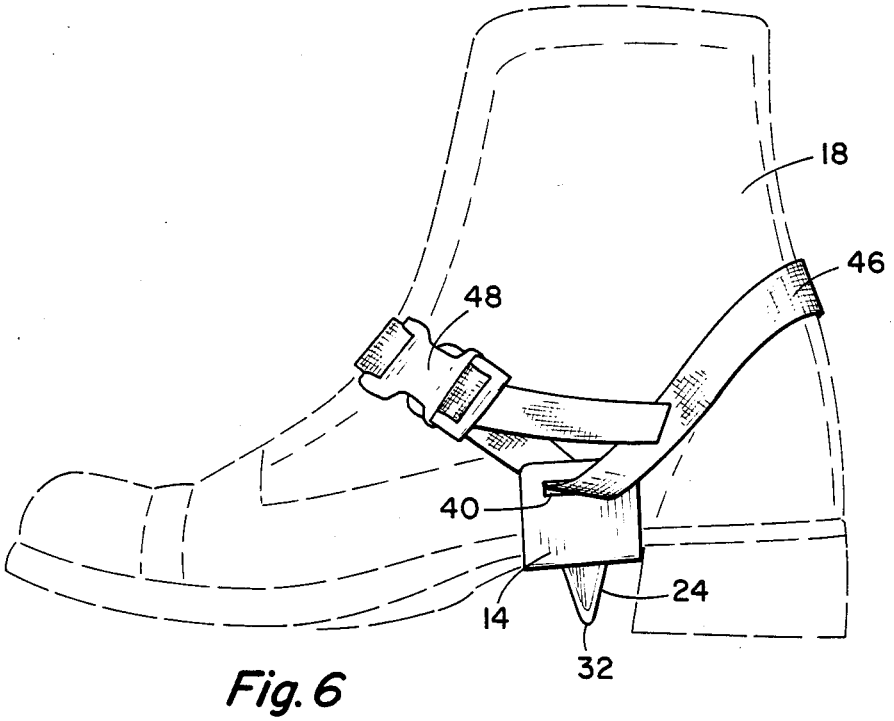
FIG. 6 is an elevational view of an opposite side of a boot having a tree climbing implement embodying the invention attached thereto, the boot being shown in broken lines for purposes or illustration.

Referring to the drawings in detail, reference character 10 generally indicates a tree climbing device or implement comprising a strap or bracket member 12 having a stop member 14 extending substantially perpendicularly outwardly from the plane thereof to provide a substantially L-shaped configuration for the bracket. A centrally disposed transversely extending sleeve means 16 is provided at the opposite end of the strap 12 and is preferably of a length less than the width of the strap 12 as particularly shown in FIG. 2. The overall length of the strap 12 between the sleeve 16 and stop means 14 is preferably of a dimension substantially corresponding to the width of a boot 18, or the like, whereby the strap 12 may be easily placed against the sole of the boot and extend transversely thereacross as shown in FIGS. 5 and 6 and as will be hereinafter set forth in detail.

A spike-like element is generally indicated at 20 and comprises an elongated metallic plate or strap member 22 which is bent or formed in such a manner as to provide an outwardly extending centrally disposed spike or tree embedding member 24 extending longitudinally throughout the length thereof and preferably beyond one end thereof as will be evident from the drawings. The spike member 24 is of a generally V-shaped cross-sectional configuration, with the depth of the Vee increasing in the direction from the outer end 26 (FIG. 1) of the strap 22 and toward the opposite end thereof. The uppermost end of the spike member 24, as viewed in FIG. 1, preferably terminates flush with the end 26 of the strap 22. The lowermost end of the spike member 24 extends beyond the opposite end of the strap 22, and the inner edge 28 of the tapers in a direction toward the said opposite end of the strap 22. The juncture between the tapered or angularly disposed edge 28 of the spike member 24 and the longitudinally extending central terminus 30 thereof for a point 32 which is sufficiently sharp as to penetrate a tree trunk during a tree climbing operation.

The said opposite end of the strap 22 is provided with a pair of spaced transversely extending axially aligned sleeve members 34 and 36. The sleeve members 34 and 36 extend outwardly from the plane of the strap 22 in a direction opposite from the spike member 24, and are adapted to receive the sleeve means 16 therebetween. Suitable hinge pin means 38 extends through the sleeves 34, 16 and 36 for hingedly securing the spike-like element 20 to the strap 12. When the device 10 is not in use the spike-like element 20 may be moved about the hinge pin 38 in a direction toward the strap 12 and to the position shown in broken lines in FIG. 1. When the device 10 is to be attached to the boot 18, or the like, the spike-like element 20 may be pivoted in the direction indicated by the arrow A and to the position indicated in solid lines in FIG. 1. It may be desirable to provide stop means (not shown) for limiting the pivotal movement of the spike-like element 20 in the direction indicated by the arrow A.

Figure 3:
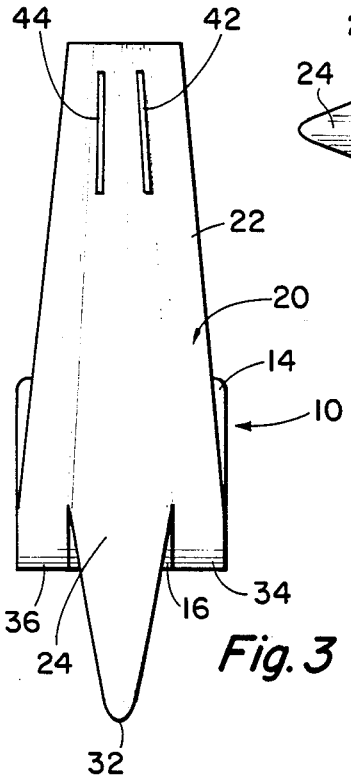
FIG. 3 is a front elevational view of a tree climbing implement embodying the invention.
Figure 1:
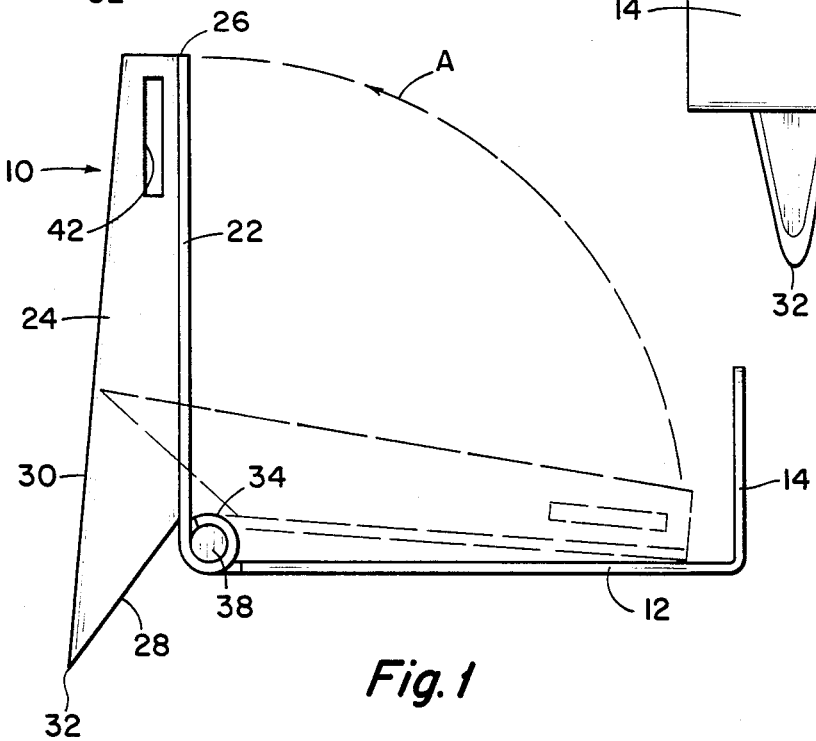
FIG. 1 is a side elevational view of a tree climbing implement embodying the invention, with the normal operational model therefor shown in solid lines and the folded storage position thereof shown in broken lines.

The stop member 14 is provided with a transversely extending elongated slot 40 in the proximity of the outer end thereof. The uppermost end of the spike member 24, as viewed in FIGS. 1 and 3, is provided with a pair of substantially aligned longitudinally extending elongated slots 42 and 44. The slots 40, 42 and 44 receive a strap means 46 therethrough for facilitating securing of the device 10 to the boot 18, as will be hereinafter set forth. In addition, suitable buckle means 48 is provided for the strap means 46 in order to secure the strap and device 10 on the boot 18.

In use, the spike-like means 20 may be manually moved to the position shown in solid lines in FIG. 1 whereby the strap 12 may be placed against the under side of the sole of the boot 18. The stop member 14 is to be positioned against the outer portion of the boot as shown in FIG. 6, and the spike-like means 20 is to be positioned against the inner side of the boot as shown in FIG. 7. The strap means 46 may be manually threaded through the slots 40, 44 and 42, preferably in such a manner that the buckle means 48 is disposed in the proximity of the top of the foot encased within the boot 18 as will be evident in FIG. 6. The buckle means 48 may be utilized in the normal manner for securing the belt means 46 around the boot 18, thus securing the device 10 against the sole of the boot. The spike member 24 is thus positioned on the inner side of the boot or shoe of the user of the device 10. The sharpened point 32 extends downwardly and angularly away from the foot encasing portion of the boot whereby the point 32 may be freely inserted into or embedded in the trunk of a tree (not shown), or the like during a normal tree climbing operation.

When the device is no longer required for service in connection with the tree climbing operation, the strap means 46 may be released from the engagement with the boot 18 by release of the buckle means 48 in the usual manner. The spike-like means 20 may be manually moved into the storage position therefor whereby the manipulation and transporting thereof is greatly facilitated. The novel unitary construction of the spike-like means 20 not only reduces the cost of manufacture of the device 10, but also permits the use of the hinge connection between the means 20 and the strap 12 which permits the folding action for the device 10.

From the foregoing, it will be apparent that the present invention provides a novel tree climbing device or implement having a shoe or boot engaging bracket means hingedly secured to a spike-like element whereby the device may be conveniently folded into a compact unit for storage or transporting. The construction of the device is economical and the operation of the device is extremely simple and efficient.

Whereas the present invention has been described in particular relation to the drawings attached hereto, it should be understood that other and further modifications, apart from those shown or suggested herein may be made within the spirit and scope of this invention.

What is claimed is:

1. A tree climbing implement adapted to be secured to a boot of a wearer and comprising bracket means for transverse engagement across the bottom of the boot and spanning the width thereof, and V-shaped spike-like means hingedly secured to one end of the bracket means for rotation about an axis that is transverse to the bracket and movable between an extended vertical position, with the spike-like means pointed downward, and a collapsed horizontal position substantially parallel to the bracket means.

2. A tree climbing implement as set forth in claim 1 and including strap means engagable with the bracket means and spike-like means for removably securing the implement on the boot.

* * * * *